US010465698B2

(12) United States Patent
Castan et al.

(10) Patent No.: US 10,465,698 B2
(45) Date of Patent: Nov. 5, 2019

(54) COMPRESSOR WHEEL SHAFT WITH RECESSED PORTION

(75) Inventors: Joel Castan, Chantraine (FR); Dominique Armand, Uxegney (FR); Gerard Dieudonne, Les Forges (FR); Olivier Millotte, Les Forges (FR); Lionel Toussaint, Gerardmer (FR)

(73) Assignee: Garrett Transportation I Inc., Torrance, CA (US)

( * ) Notice: Subject to any disclaimer, the term of this patent is extended or adjusted under 35 U.S.C. 154(b) by 1552 days.

(21) Appl. No.: 13/291,466

(22) Filed: Nov. 8, 2011

(65) Prior Publication Data

US 2013/0115088 A1 May 9, 2013

(51) Int. Cl.
*F04D 29/28* (2006.01)
*F04D 29/054* (2006.01)
(Continued)

(52) U.S. Cl.
CPC ..... *F04D 29/284* (2013.01); *F01D 5/025* (2013.01); *F04D 25/024* (2013.01);
(Continued)

(58) Field of Classification Search
CPC ..... F01D 5/025; F04D 29/00; F04D 29/053; F04D 29/20; F04D 29/266;
(Continued)

(56) References Cited

U.S. PATENT DOCUMENTS 3,043,636 A * 7/1962 MacInnes et al. ..... 384/287
4,235,484 A * 11/1980 Owen et al. ..... 384/398
(Continued)

FOREIGN PATENT DOCUMENTS

DE 35 32 348 A1 3/1986
DE 1 193 370 A2 4/2002
(Continued)

OTHER PUBLICATIONS

Gunter and Chen, "Dynamic analysis of a turbocharger in floating bushing bearings", ISCORMA-3, Cleveland, Ohio, Sep. 19-23, 2005.

(Continued)

*Primary Examiner* — Justin D Seabe
*Assistant Examiner* — Justin A Pruitt
(74) *Attorney, Agent, or Firm* — Brian J. Pangrle

(57) ABSTRACT

A turbocharger assembly includes a compressor wheel with a base surface, a nose surface, a z-plane disposed between the base surface and the nose surface and a bore extending from the base surface to the nose surface and a shaft that includes a first pilot surface disposed in the bore of the compressor wheel at a position between the z-plane and the nose surface, a second pilot surface disposed in the bore of the compressor wheel at a position between the z-plane and the base surface, and a recessed surface disposed between the first pilot surface and the second pilot surface. A nut adjustably disposed on the shaft adjacent to the nose surface can tension the shaft to apply a compressive load between the base surface and the nose surface of the compressor wheel. Various other examples of devices, assemblies, systems, methods, etc., are also disclosed.

15 Claims, 8 Drawing Sheets

(51) Int. Cl.
*F04D 29/26* (2006.01)
*F04D 25/02* (2006.01)
*F01D 5/02* (2006.01)

(52) U.S. Cl.
CPC ..... *F04D 29/054* (2013.01); *F04D 29/266* (2013.01); *F05D 2220/40* (2013.01); *Y10T 29/49321* (2015.01)

(58) Field of Classification Search
CPC ..... F05D 2220/40; F05D 2230/64; F05D 2240/60; F05D 2260/30; F16D 1/06
USPC ..... 415/104, 206, 216.1; 416/174; 29/889.21
See application file for complete search history.

(56) References Cited

U.S. PATENT DOCUMENTS 4,486,147 A 12/1984 Byrne et al.
4,890,946 A 1/1990 von Pragenau
5,022,823 A 6/1991 Edelmayer
5,025,629 A * 6/1991 Woollenweber ..... 60/600
5,145,334 A * 9/1992 Gutknecht ..... F01D 25/164 417/407
5,163,816 A * 11/1992 Goetzke et al. ..... 416/204 A
5,193,989 A 3/1993 Fleury
6,364,634 B1 * 4/2002 Svihla et al. ..... 417/409
6,478,553 B1 * 11/2002 Panos ..... F01D 25/16 310/90
6,481,970 B2 * 11/2002 Mukherjee et al. ..... 416/204 A
6,896,479 B2 * 5/2005 Svihla et al. ..... 415/104
7,160,082 B2 * 1/2007 Allen ..... F01D 5/027 415/229
7,470,115 B2 12/2008 Meacham et al.
7,722,336 B2 5/2010 Vaccarezza
7,886,536 B2 * 2/2011 Hemer ..... 60/602
2004/0131469 A1 7/2004 Billington
2008/0260520 A1 * 10/2008 Hettinger et al. ..... 415/163
2011/0197849 A1 * 8/2011 Wright ..... 123/241

FOREIGN PATENT DOCUMENTS

DE 10 2010 010136 A1 9/2011
JP 2002089490 A 3/2002
WO 2010/111133 A2 9/2010
WO 2011/087662 A2 7/2011
WO 2011087662 A2 7/2011

OTHER PUBLICATIONS

EP Application No. / Patent No. 12191478.2-1616 / 2592280, EP Search Report dated Oct. 4, 2017 (5 pages).
EP Application No. / Patent No. 12191478.2-1616 / 2592280, EP Examination Report dated Oct. 30, 2017 (7 pages).

* cited by examiner

Increase Load/Stretch Window for Temperature

Increase Load/Stretch Window for Rotational Speed

Increase Load/Stretch Window

COMPRESSOR WHEEL SHAFT WITH RECESSED PORTION

TECHNICAL FIELD

Subject matter disclosed herein relates generally to turbomachinery for internal combustion engines and, in particular, to compressor wheel shafts that include a recessed portion.

BACKGROUND

Exhaust driven turbochargers include a rotating group that includes a turbine wheel and a compressor wheel that are connected to one another by a shaft. During operation, depending on factors such as size of various turbocharger components, a shaft may be expected to rotate at speeds in excess of 200,000 rpm. To ensure proper rotordynamic performance, a rotating group should be well balanced and well supported over a wide range of conditions (e.g., operational, temperature, pressure, etc.).

Technologies, techniques, etc., described in various examples herein can reduce risk of damage to a turbocharger subject to various conditions. Such technologies, techniques, etc., may increase production quality, increase performance, reduce noise, reduce vibration, reduce harshness, or achieve other benefits for turbomachinery.

BRIEF DESCRIPTION OF THE DRAWINGS

A more complete understanding of the various methods, devices, assemblies, systems, arrangements, etc., described herein, and equivalents thereof, may be had by reference to the following detailed description when taken in conjunction with examples shown in the accompanying drawings where.

DETAILED DESCRIPTION

Figure 1A:
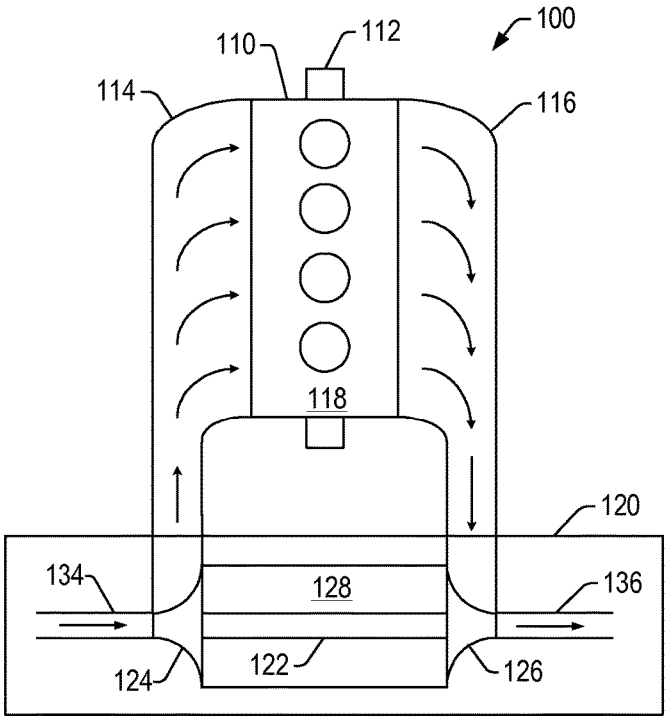
Fig. 1A (prior art)
FIGS. 1A and 1B are diagrams of an example of a turbocharger and an internal combustion engine along with an example of a controller.

As an example, a turbocharger assembly can include a compressor wheel with a base surface, a nose surface, a z-plane disposed between the base surface and the nose surface and a bore extending from the base surface to the nose surface and a shaft that includes a first pilot surface disposed in the bore of the compressor wheel at a position between the z-plane and the nose surface, a second pilot surface disposed in the bore of the compressor wheel at a position between the z-plane and the base surface, and a recessed surface disposed between the first pilot surface and the second pilot surface. Such an assembly may further include a nut adjustably disposed on the shaft adjacent to the nose surface of the compressor wheel where adjustment of the nut tensions the shaft to apply a compressive load between the base surface and the nose surface of the compressor wheel.

During periods of use and nonuse, a shaft and a compressor wheel of a turbocharger (e.g., arranged as in the foregoing example) are exposed to various temperatures, which may cause the shaft and the compressor wheel, as well as other components, to expand or contract. Where the components are made of different materials, their individual linear coefficients of thermal expansion may differ, which can result in alteration of loads (e.g., forces), clearances, etc. Linear coefficients of thermal expansion may differ considerably, for example, stainless steel (316) is about $16\times10^{-6}$ m/mK, aluminum is about $22\times10^{-6}$ m/mK and titanium is about $9\times10^{-6}$ m/mK. Thus, for a one degree change in temperature (C or K), aluminum will expand linearly more than stainless steel, which will expand linearly more than titanium.

Where a component experiences strain in one direction, strain in another direction may be characterized by Poisson's ratio of the material from which the component is made. For example, where a component is compressed in one direction, it may expand in another direction and, similarly, where a component is tensioned in one direction, it may contract in another direction. Poisson's ratio may be formally defined as the ratio of transverse strain (perpendicular to the applied load) to axial strain (in the direction of the applied load). For isotropic stainless steel, Poisson's ratio is about 0.30 to 0.31; for an isotropic aluminum alloy, it tends to be slightly higher, about 0.33. For isotropic titanium, Poisson's ratio is about 0.34. Some materials can have a negative Poisson's ratio.

For components of a turbocharger assembly, an understanding of strain stems from an understanding of stress. The relationship between stress and strain of an elastic material may be characterized by the material's Young's modulus, which may be defines as the ratio of uniaxial stress over uniaxial strain over a range of stress for which Hooke's law applies (e.g., reversible strain). In solid mechanics, the slope of the stress-strain curve at any point is the tangent modulus and the initial, linear portion of a strain-strain curve is the Young's modulus (or tensile modulus or modulus of elasticity). Young's modulus depends on temperature, where for a temperature of about 20° C., steel is about $27\times10^{6}$ psi, titanium is about $14\times10^{6}$ psi and aluminum is about $9\times10^{6}$ psi.

During periods of operation, rotating components experience considerable centripetal force, which may be determined by mass, radius of the mass and angular velocity. Mass may be determined using density and volume of a material, for example, where the density of stainless steel is about 8,000 kg/m$^3$, aluminum is about 2,700 kg/m$^3$ and titanium is about 4,500 kg/m$^3$. Given a centripetal force (e.g., stress), an amount of radial strain may be predicted using Young's modulus. In turn, using Poisson's ratio, an amount of axial strain may be predicted. Where Poisson's ratio is positive (e.g., steel, aluminum, titanium, etc.), the axial strain will be negative. For example, an aluminum alloy compressor wheel spinning at 100,000 rpm will expand radially and contract axially.

As described herein, a compressor wheel can be attached to a shaft in a manner where the compressor wheel and the shaft are expected to rotate as a unit (e.g., rotational slippage of a shaft about a compressor wheel should be minimal). For example, a compressor wheel can include a through-bore for receipt of a shaft where a mechanism acts to secure the compressor wheel. An attachment mechanism can include a nut that threads onto an end of the shaft where a surface of the nut can apply compressive force to the compressor wheel to clamp the compressor wheel between the nut and another surface such as a surface of a thrust collar. In such an example, the shaft may include a shoulder that seats against a surface of the thrust collar such that tightening of the nut causes a portion of the shaft (e.g., between the surface of the thrust collar and the nut) to experience tension or tensile stress. Tensile stress acts to elongate a material along the direction of an applied load, which, according to Poisson's ratio will result in some contraction in another direction. Tensile stress may be defined as load divided by area. Accordingly, where a shaft has a smaller cross-sectional area (e.g., diameter), it will have a higher tensile stress.

As described herein, a compressor wheel can include a base surface and a nose surface as well as a z-plane disposed between the base surface and the nose surface and a bore extending from the base surface to the nose surface and a shaft can include a first pilot surface disposed in the bore of the compressor wheel at a position between the z-plane and the nose surface, a second pilot surface disposed in the bore of the compressor wheel at a position between the z-plane and the base surface, and a recessed surface disposed between the first pilot surface and the second pilot surface. In the foregoing example, the portion of the shaft having the recessed surface has a smaller cross-sectional area (e.g., diameter) than the first pilot surface or the second pilot surface. In such an example, the tensile stress is higher along the portion of the shaft having the recessed surface, which, in turn, means that the tensile stress is less at the portions of the shaft that correspond to the two pilot surfaces. As strain depends on stress, strain is greater along the portion of the shaft having the recessed surface.

As described herein, a shaft configured to carry a higher tensile stress over a particular portion of the shaft can act to diminish overall percentage variations in tensile stress responsive to temperature, rotational speed and temperature and rotational speed. In such an example, a load/stretch window for the shaft and compressor wheel assembly is increased. As described herein, a shaft can include a recess or undercut (e.g., disposed between two pilots) that allows the shaft to be more flexible and have a larger load/stretch window, which can further benefit high volume serial production of turbocharger assemblies.

For a shaft and compressor wheel assembly, a load/stretch window may be defined with respect to a minimum load requirement, for example, defined to maintain aero torque, and to avoid slippage of a compressor, balancing degradation and shaft breaking after fatigue. A worst case scenario may be defined with respect to low temperature and high rotational speed. A load/stretch window may also be defined with respect to a maximum load requirement, for example, defined to avoid increased stretch, up to irreversible elasticity and shaft breaking. A worst case scenario may be defined with respect to high temperature and little or no rotational speed, which may occur, for example, upon a hot shut down (e.g., turbocharger is hot and the compressor wheel is not rotating).

As described herein, a turbocharger assembly can include: a housing that includes a bore; a bearing disposed in the bore of the housing; a compressor wheel that includes a base surface, a nose surface, a z-plane disposed between the base surface and the nose surface and a bore extending from the base surface to the nose surface; a shaft rotatably supported by the bearing in the bore of the housing wherein the shaft includes a first pilot surface disposed in the bore of the compressor wheel at a position between the z-plane and the nose surface, a second pilot surface disposed in the bore of the compressor wheel at a position between the z-plane and the base surface, and a recessed surface disposed between the first pilot surface and the second pilot surface; a thrust collar disposed about the shaft between the bearing and the base surface of the compressor wheel; and a nut adjustably disposed on the shaft adjacent to the nose surface of the compressor wheel where adjustment of the nut tensions the shaft to apply a compressive load between the base surface and the nose surface of the compressor wheel.

As described herein, a shaft may include a pilot having a press-fit surface such that the pilot can be press-fit (e.g., a type of interference fit) into a bore of a compressor wheel. In such an example, the pilot having the press-fit surface may be one of two or more pilots where, for example, each of the other pilots has a respective diameter sufficiently small to avoid interference in the bore of the compressor wheel but sufficiently large to define a predetermined amount of play with respect to the bore of the compressor wheel. As described herein, a shaft may include, for example, an interference pilot and a play pilot where, once disposed in a bore of a compressor wheel, the interference pilot provides for an interference fit while the play pilot provides for a predetermined amount of play (e.g., over a range of operational conditions).

With respect to a pilot disposed at or near a nose end of a compressor wheel, such a pilot can help to minimize or limit bending of a shaft. For example, for a shaft having a single pilot disposed at or near a base end of a compressor wheel (e.g., between a z-plane and a base surface of a compressor wheel) and a portion extending therefrom having an axial length with a smaller diameter (e.g., smaller than a bore diameter of the compressor wheel) that extends to a threaded portion for receipt of a nut, the shaft may experience bending (e.g., limited by contact between the shaft and the bore of the compressor wheel at the nose end; noting that the nut may slide along a nose surface of the wheel). Such bending can be detrimental and may shift center of gravity of a compressor wheel assembly. To avoid or limit such bending, a shaft can include, for example, two pilots where one of the pilots is disposed at or near a nose end of a wheel (e.g., optionally without or with clearance between a bore of the wheel).

Below, an example of a turbocharged engine system is described followed by various examples of components, assemblies, methods, etc.

Figure 1B:
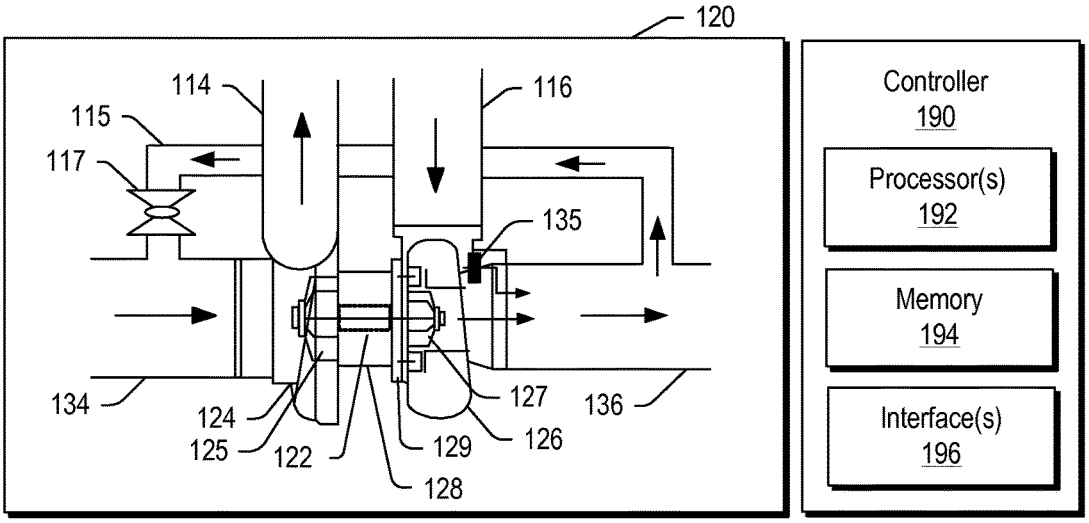
Fig. 1B (prior art)

Turbochargers are frequently utilized to increase output of an internal combustion engine. Referring to FIG. 1, a conventional system 100 includes an internal combustion engine 110 and a turbocharger 120. The internal combustion engine 110 includes an engine block 118 housing one or more combustion chambers that operatively drive a shaft 112 (e.g., via pistons). As shown in FIG. 1, an intake port 114 provides a flow path for air to the engine block 118 while an exhaust port 116 provides a flow path for exhaust from the engine block 118.

Also shown in FIG. 1, the turbocharger 120 includes an air inlet 134, a shaft 122, a compressor 124, a turbine 126, a housing 128 and an exhaust outlet 136. The housing 128 may be referred to as a center housing as it is disposed between the compressor 124 and the turbine 126. The shaft 122 may be a shaft assembly that includes a variety of components. In operation, the turbocharger 120 acts to extract energy from exhaust of the internal combustion engine 110 by passing the exhaust through the turbine 126. As shown, rotation of a turbine wheel 127 of the turbine 126 causes rotation of the shaft 122 and hence a compressor wheel 125 (e.g., impeller) of the compressor 124 to compress and enhance density of inlet air to the engine 110. By introducing an optimum amount of fuel, the system 100 can extract more specific power out of the engine 100 (e.g., compared to a non-turbocharged engine of the same displacement). As to control of exhaust flow, in the example of FIG. 1, the turbocharger 120 includes a variable geometry unit 129 and a wastegate valve 135. The variable geometry unit 129 may act to control flow of exhaust to the turbine wheel 127. The wastegate valve (or simply wastegate) 135 is positioned proximate to the inlet of the turbine 126 and can be controlled to allow exhaust from the exhaust port 116 to bypass the turbine wheel 127.

Further, to provide for exhaust gas recirculation (EGR), such a system may include a conduit to direct exhaust to an intake path. As shown in the example of FIG. 1, the exhaust outlet 136 can include a branch 115 where flow through the branch 115 to the air inlet path 134 may be controlled via a valve 117. In such an arrangement, exhaust may be provided upstream of the compressor 124.

In FIG. 1, an example of a controller 190 is shown as including one or more processors 192, memory 194 and one or more interfaces 196. Such a controller may include circuitry such as circuitry of an engine control unit. As described herein, various methods or techniques may optionally be implemented in conjunction with a controller, for example, through control logic. Control logic may depend on one or more engine operating conditions (e.g., turbo rpm, engine rpm, temperature, load, lubricant, cooling, etc.). For example, sensors may transmit information to the controller 190 via the one or more interfaces 196. Control logic may rely on such information and, in turn, the controller 190 may output control signals to control engine operation. The controller 190 may be configured to control lubricant flow, temperature, a variable geometry assembly (e.g., variable geometry compressor or turbine), a wastegate, an exhaust gas recirculation valve, an electric motor, or one or more other components associated with an engine, a turbocharger (or turbochargers), etc.

Figure 2A:
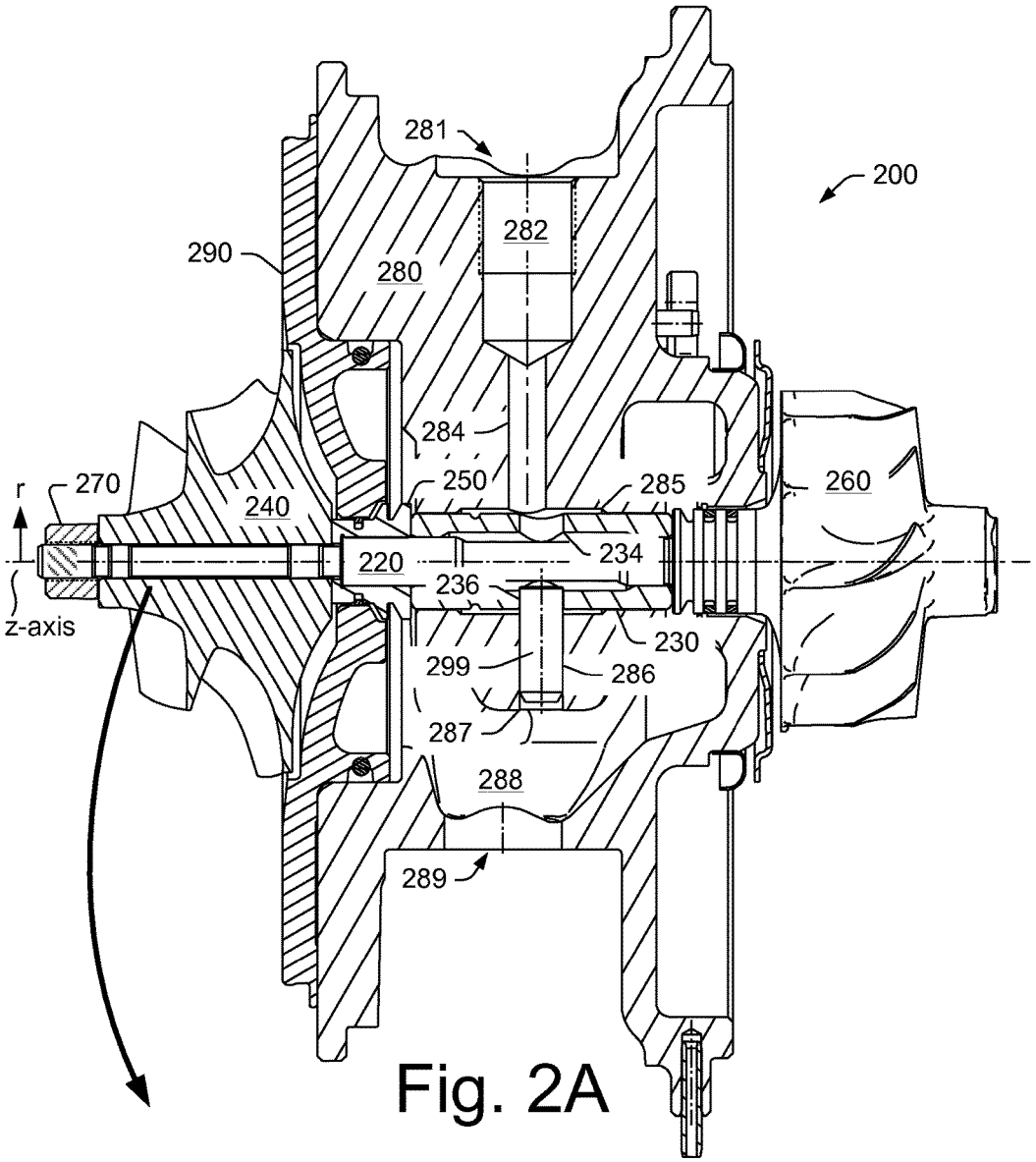
FIGS. 2A and 2B are a series of cross-sectional views of an example of a turbocharger assembly that includes a compressor wheel shaft with pilot surfaces.
Figure 2B:
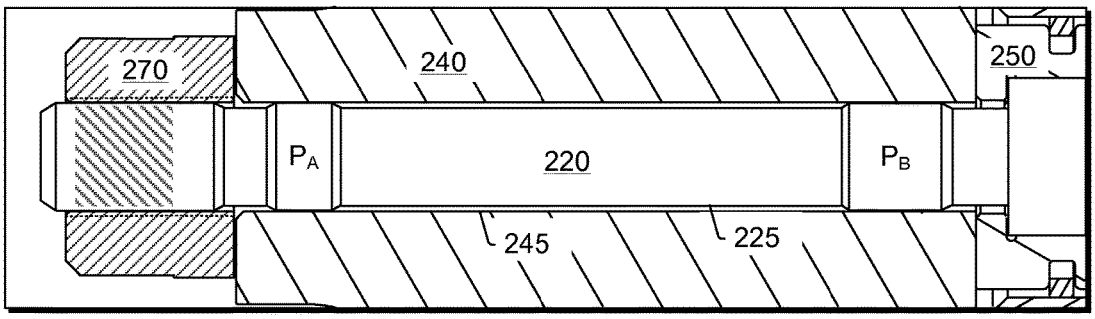
Figure 3A:
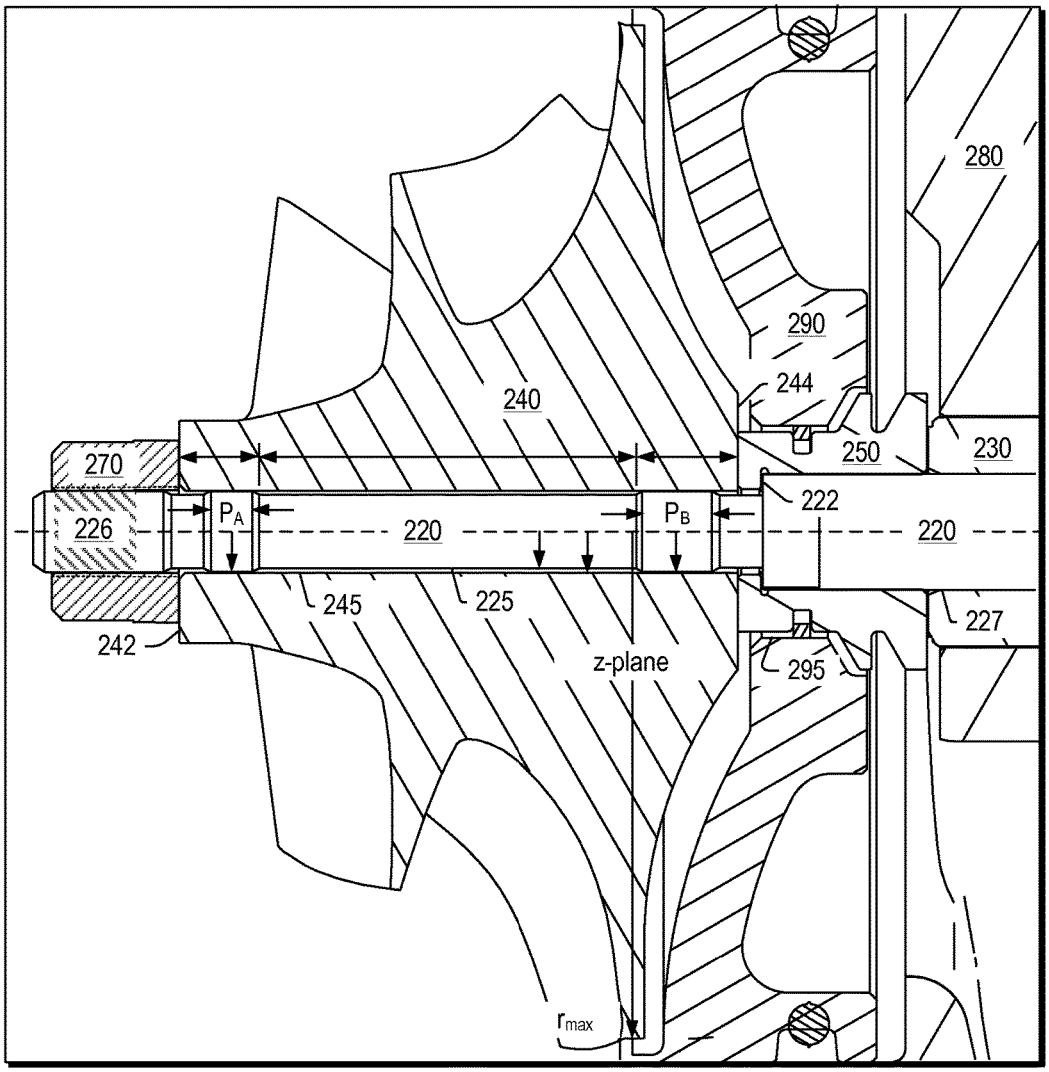
FIGS. 3A, 3B, 3C and 3D are a series of cross-sectional views of the assembly of FIG. 2 and components to load the compressor wheel shaft.
Figure 3B:
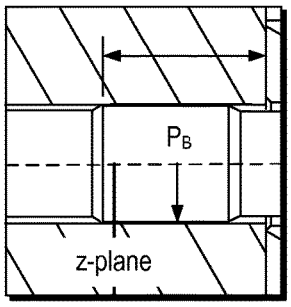
Figure 3C:
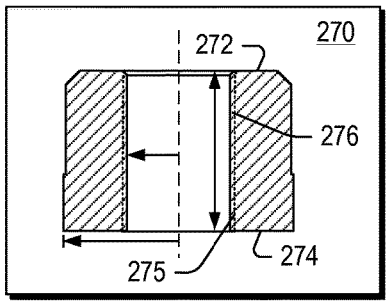
Figure 3D:
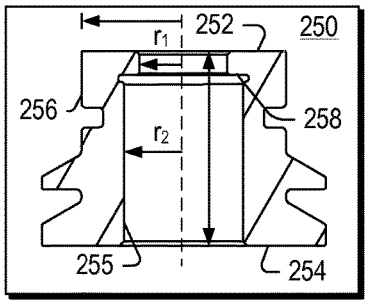

FIG. 2 shows two cross-sectional views of an example of an assembly 200 that includes a shaft 220, a bearing 230, a compressor wheel 240, a thrust collar 250, a turbine wheel 270, a housing 280 and a back plate 290. The bearing 230 includes an upper opening 234, for example, to receive lubricant (e.g., oil) via lubricant passage 281, 282 and 284 of the housing 280. The bearing 230 also includes a lower opening 236, which receives a portion of a locating pin 299 to locate the bearing 230 in a bore 285 of the housing between the thrust collar 250 and the turbine wheel 260. In the example of FIG. 2, the locating pin 299 is disposed partially in a locating pin recess 286 having an opening 287 to a lubricant well 288 accessible via a lubricant drain 289 of the housing 280.

In an enlarged cross-sectional view, the shaft 220 is shown as being received by a bore 245 of the compressor wheel 240 including two pilot surfaces $P_A$ and $P_B$ and a recessed or undercut portion 225 therebetween. As indicated, the compressor wheel 240 is disposed on the shaft 220 between the thrust collar 250 and the nut 270. The portion of the shaft 220 shown (e.g., for purposes of securing a compressor wheel) may be referred to as a "stub shaft".

FIG. 3 shows additional cross-sectional views of the assembly 200 of FIG. 2. In the example of FIG. 3, the compressor wheel 240 is shown as including a nose surface 242 and a base surface 244 where the bore 245 extends axially between these surfaces. While the nose surface 242 and the base surface 244 are shown as being axial faces, for example, having the z-axis perpendicular thereto, such faces may have sloped shapes or other shapes to cooperate with mating surfaces, for example, of a nut or a thrust collar. Further, the compressor wheel 240 is shown as having a z-plane that corresponds approximately to a largest diameter of the compressor wheel 240. In FIG. 3, a largest diameter or radius, indicated by $r_{max}$, at the hub of the wheel 240 coincides with the z-plane (e.g., noting that a blade or blades extending from the hub may include a larger radius). Given the z-plane as a point of reference, the pilot A of the shaft 220 can be described as residing axially between the z-plane and the nose surface 242 of the compressor wheel 240 while the pilot B of the shaft 220 can be described as residing, at least partially, axially between the z-plane and the base surface 244 of the compressor wheel 240. For example, in FIG. 3A the pilot B resides axially between the z-plane and the base surface 244 and in FIG. 3B the pilot B resides partially axially between the z-plane and the base surface 244. As shown in FIG. 3B, the pilot B is disposed in the bore of the compressor wheel 240 at a position between the z-plane and the base surface 244 where the pilot B extends partially beyond the z-plane towards the nose surface 242 of the compressor wheel 240. As shown, the recessed surface 225 of the shaft 220 resides between the pilots A and B and has a diameter (e.g., cross-sectional area) less than that of pilot A or pilot B.

In the example of FIG. 3, the shaft 220 is shown as including adjustment features 226 to cooperate with adjustment features 276 of the nut 270. For example, an adjustment mechanism to adjust load applied to a compressor wheel (e.g., tensile load to a portion of a shaft) can include a threaded nut and a threaded shaft whereby rotation of one with respect to the other alters the load applied to the compressor wheel (e.g., tensile load to the portion of the shaft). The shaft 220 is also shown as including an outer surface 227 that extends to a shoulder 222.

In the example of FIG. 3, the thrust collar 250 is shown as including a compressor wheel facing surface 252, a bearing facing surface 254 and a bore 255 extending therebetween. As shown in the example of FIG. 3, a bore can include a first portion at a first diameter (see, e.g., radius $r_1$) and a second portion at a second diameter (see, e.g., radius $r_2$). The thrust collar 250 further includes an outer surface 256 and an interior surface 258, which is configured to seat the shoulder 222 of the shaft 220. While the example of FIG. 3 shows the surface 258 and the shoulder 222 contacting in a planar manner, these surfaces may have other shapes (e.g., conical, etc.).

In the example of FIG. 3, the nut 270 is shown as including an end surface 272, a compressor facing surface 274 and a bore 275 extending therebetween where, for example, the adjustment features 276 may span the entire axial length or only a portion of the axial length of the bore.

In the example of FIG. 3, the back plate 290 is shown as including a bore 295 that receives the thrust collar 250, for example, with a ring seated in a groove of the thrust collar 250 to seal a compressor wheel space from a back plate/housing space.

To apply a compressive load to the compressor wheel 240, the nut 270 may be adjusted with respect to the shaft 220 to cause the shoulder 222 of the shaft 220 to apply force to the interior surface 258 of the thrust collar 250, which, in turn, applies force to the base surface 244 of the compressor wheel 240. Thus, a compressive force is applied to the compressor wheel 240 between the nose surface 242 and the base surface 244 while a tensile force is applied to the shaft 220 between the adjustment features 226 and the shoulder 222. As mentioned, tensile stress depends on cross-sectional area; thus, portions of the shaft 220 located between the adjustment features 226 and the shoulder 222 of smaller cross-section will have higher tensile stress.

Figure 4A:
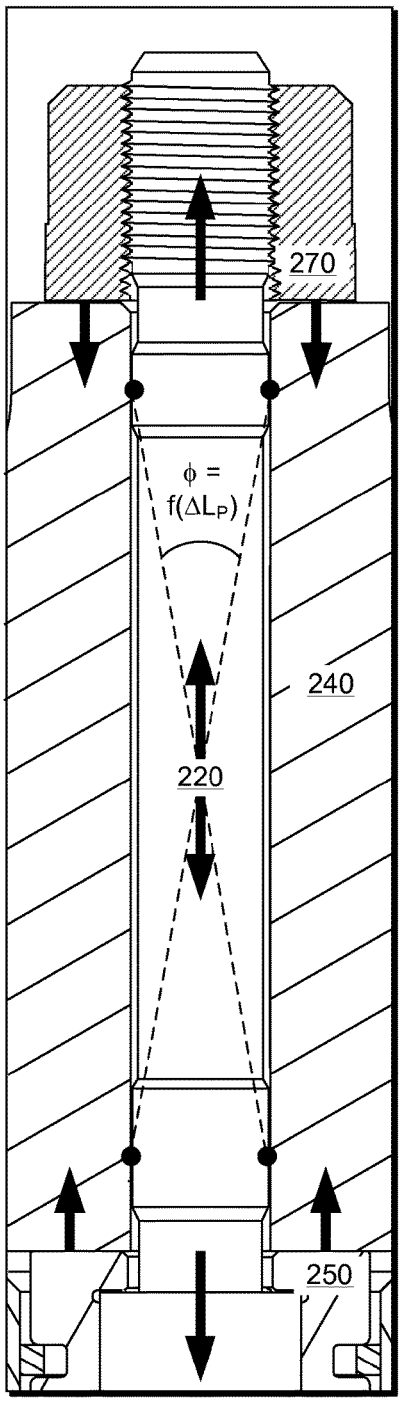
FIGS. 4A and 4B are a series of side views of the compressor wheel shaft of FIG. 3 along with an example of a loading mechanism.
Figure 4B:
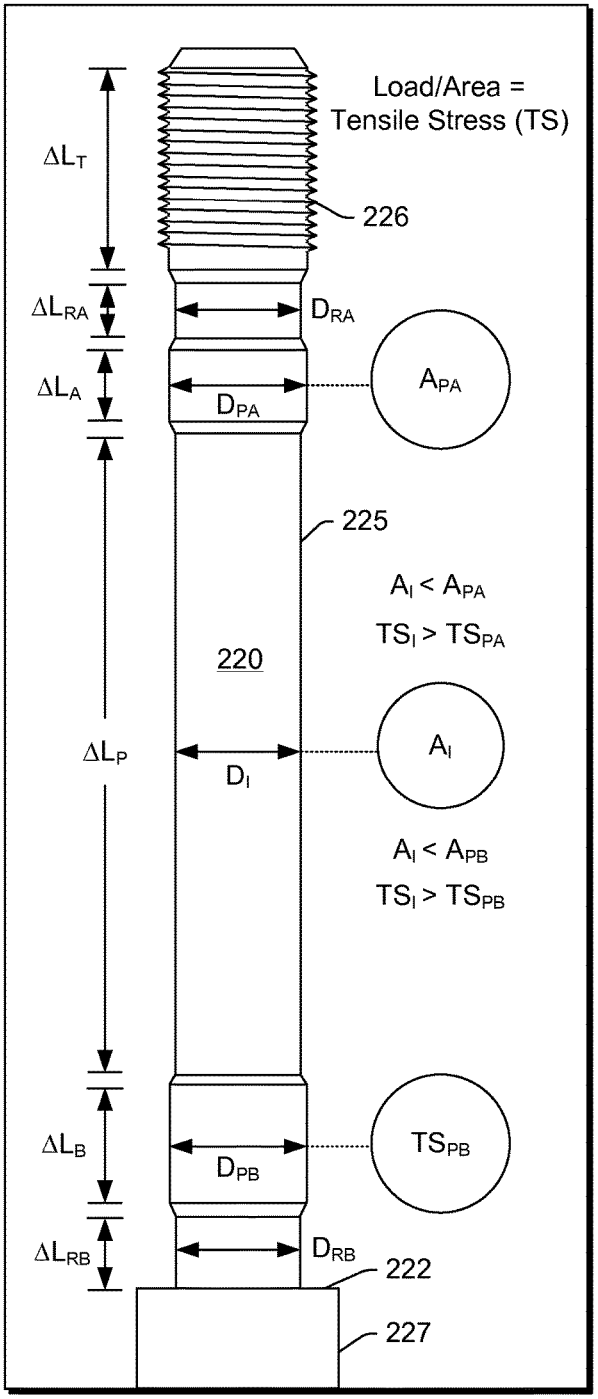

FIG. 4 shows an approximate force diagram along with another diagram that illustrates some dimensions of the shaft 220. In the force diagram, the shaft 220 is shown as having tensile stress while the compressor wheel 240 is shown as having compressive stress. Further, an angle $\phi$ is shown as being dependent on an axial span (e.g., $\Delta L_P$) between the two pilots A and B. Where the diameter of the pilots A and B differ, the angle corresponding to the larger diameter will be slightly larger than the angle corresponding to the smaller diameter. In general, as axial span increases between two pilots (e.g., axial length of the recessed portion 225), compressor wheel tilt with respect to a shaft decreases. In other words, increased spacing of the pilots acts to diminish tilt between a longitudinal axis of a shaft and a longitudinal axis of a bore of a compressor wheel. In the example of FIG. 4, where the nut 270 is attached to the shaft 220, tilt may alter position of the nut (e.g., move it slightly off-axis or tilt the nut), alter application of stress by the nut, etc. and, for one or more of these reasons, a shaft may be configured to avoid or limit tilt. Also shown in FIG. 4 are recessed portions disposed between the pilot A and the adjustment features 226 (see, e.g., recessed portion of axial length $\Delta L_{RA}$ and including diameter $D_{RA}$) and between the pilot B and the shoulder 222 (see, e.g., recessed portion of axial length $\Delta L_{RB}$ and including diameter $D_{RB}$), which may be configured to position the pilots A and B with respect to the shoulder 222 (e.g., or a base surface of a wheel) and the adjustment features 226 (e.g., or a nose surface of a wheel). As described herein, a shaft that includes a recessed portion disposed between pilots can provide for considerable design flexibility (e.g., for component tolerances, process variations, duty cycles, etc.).

In the example of FIG. 4, the pilots A and B are shown as having axial lengths (e.g., $\Delta L_A$ and $\Delta L_B$) and diameters (e.g., $D_{PA}$ and $D_{PB}$). As described herein, the axial length of pilot B (base end pilot) may be greater than the axial length of pilot A (nose end pilot) and the diameter of pilot B may be greater than the diameter of pilot A. The dimensions of pilots A and B can affect tilt. In general, tilt decreases with respect to increasing axial length of a pilot and with respect to increasing diameter of a pilot. As an example, a shaft may have a pilot to be located near the base of a compressor wheel and a pilot to be located near the nose of a compressor wheel where the former is longer and wider than the latter. In such an example, the pilot located near the base may have a diameter that allows for a press-fit of the shaft into a bore of the compressor wheel; whereas, the pilot located near the nose may have a lesser diameter that allows for some predetermined, low level of play. The amount of play may be selected to facilitate assembly (e.g., allow for insertion of shaft until entry of pilot B) and to limit bending (e.g., as well as sliding of a nut on a nose surface of a compressor wheel). As described herein, bending of a shaft, sliding of a nut (e.g., off the rotational axis due to bending or tilt), or both can lead to unbalance. A shaft that includes two pilots with a recessed portion disposed therebetween can act to avoid or limit such bending or sliding and thereby avoid or limit unbalance. For an analysis of bending modes for an aluminum compressor wheel and steel shaft assembly, frictional interface between a compressor wheel and a nut, centrifugal growth, stiffness, unbalance, etc., see, e.g., Gunter and Chen, "Dynamic analysis of a turbocharger in floating bushing bearings", ISCORMA-3, Cleveland, Ohio, 19-23 Sep. 2005, which is incorporated by reference herein.

As described herein, a method may provide for a shaft having an optimum trade-off between compressor wheel locating/fixing during its life cycle (e.g., operational conditions, ambient conditions, etc.) and manufacture of parts and assembly of parts to form an assembly. For example, such a method may include adjusting dimensions and axial locations of one or more pilots to achieve an optimum amount of play or interference (e.g., pilot and compressor wheel bore interference).

As described herein, a shaft may be configured to favorably position the center of gravity of a compressor wheel and shaft assembly. For example, to shift the center of gravity away from a nose of a compressor wheel and toward a base of the compressor wheel (e.g., while maintaining the center of gravity on the rotational axis, z-axis), the shaft may include a recessed portion disposed between a base pilot and a nose pilot where mass of the base pilot exceeds mass of the nose pilot (e.g., dimensions provide for the base pilot with a larger material volume than the nose pilot).

As shown in FIG. 4, tensile stress equals load divided by cross-sectional area. Accordingly, for a given load, the tensile stress of the shaft 220 is greater along the recessed portion 225 (e.g., intermediate portion "I") than at either pilot A or pilot B. Where, for example, pilot B of the shaft 220 has a greater cross-sectional area than pilot A, the following relationship may hold: $TS_{PB}<TS_{PA}<TS_I$.

While the adjustment features 226 are shown as outer threads in the example of FIG. 4, other types of adjustment features may be employed (e.g., bayonet, inner threads, etc.) where a nut or other component may including cooperating features to thereby form an adjustment mechanism to adjustably apply a load to the compressor wheel and thereby apply tension to a shaft.

Figure 5A:
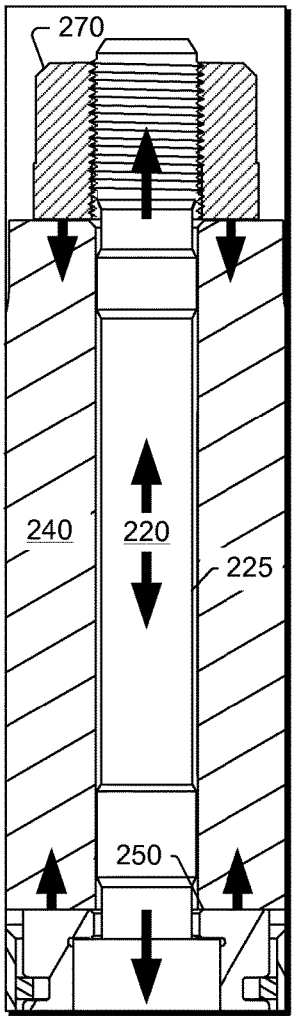
FIGS. 5A, 5B and 5C are a series of tensile stress plots for examples of compressor wheel shafts along with a side view of the example of the compressor wheel shaft of FIG. 4.
Figure 5B:
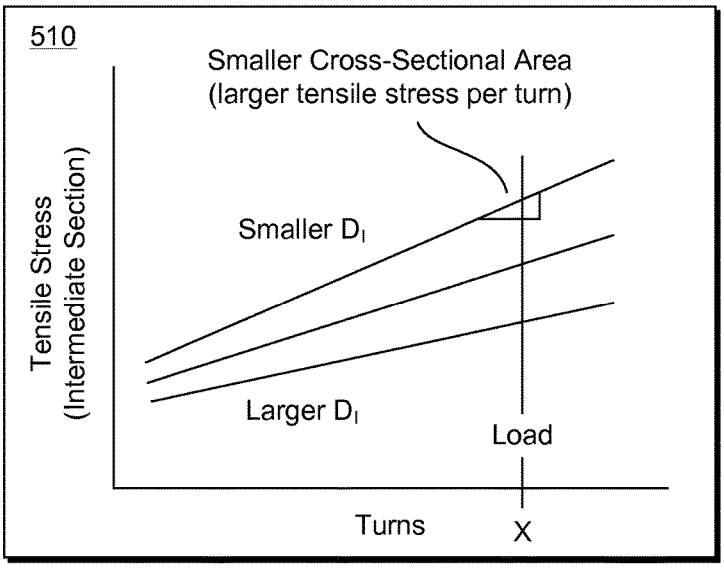
Figure 5C:
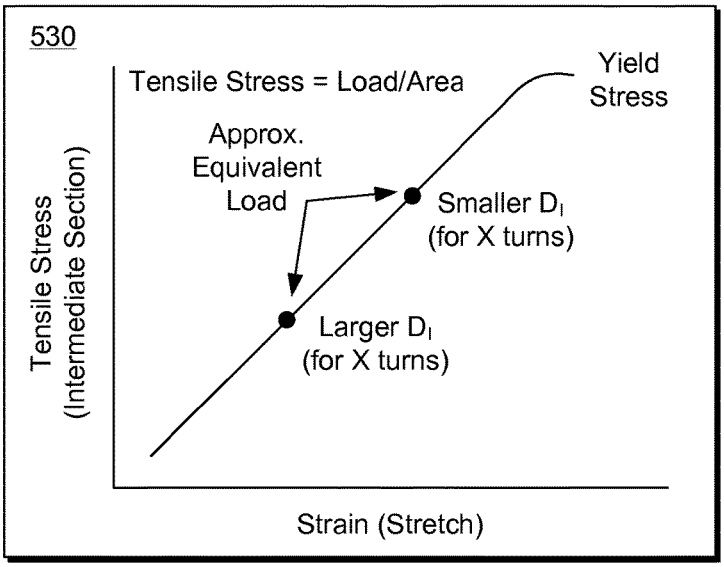

FIG. 5 shows two example plots 510 and 530 along with a cross-sectional view of a portion of the assembly 200 of FIG. 2. The plot 510 shows tensile stress for an intermediate section of a shaft (e.g., the recessed portion 225 of the shaft 200) disposed between two pilot surfaces (e.g., pilots) where tensile stress is greater for smaller diameters than larger diameters of the intermediate section. For example, for a given number of turns (e.g., X, which represents a load), a smaller diameter intermediate section has a higher tensile stress and has a steeper slope than a larger diameter intermediate section. In such an example, as to the number of turns and load, one may assume that an adjustment mechanism provides the same relationship for a shaft that includes a smaller diameter portion and a shaft that includes a larger diameter portion.

The plot 530 shows tensile stress versus strain (e.g., stretch). In the example of FIG. 5, the smaller diameter intermediate section has a higher strain than the larger diameter intermediate section given an approximately equivalent load (e.g., number of turns).

Figure 6A:
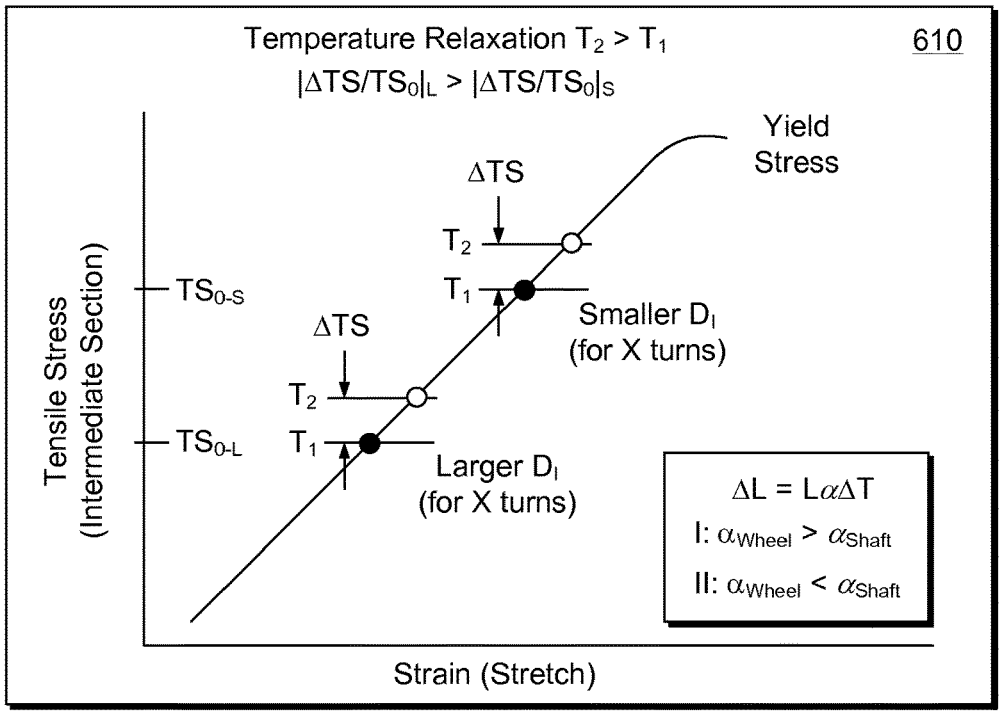
FIGS. 6A and 6B are a series of tensile stress plots for examples of compressor wheel shafts.
Figure 6B:
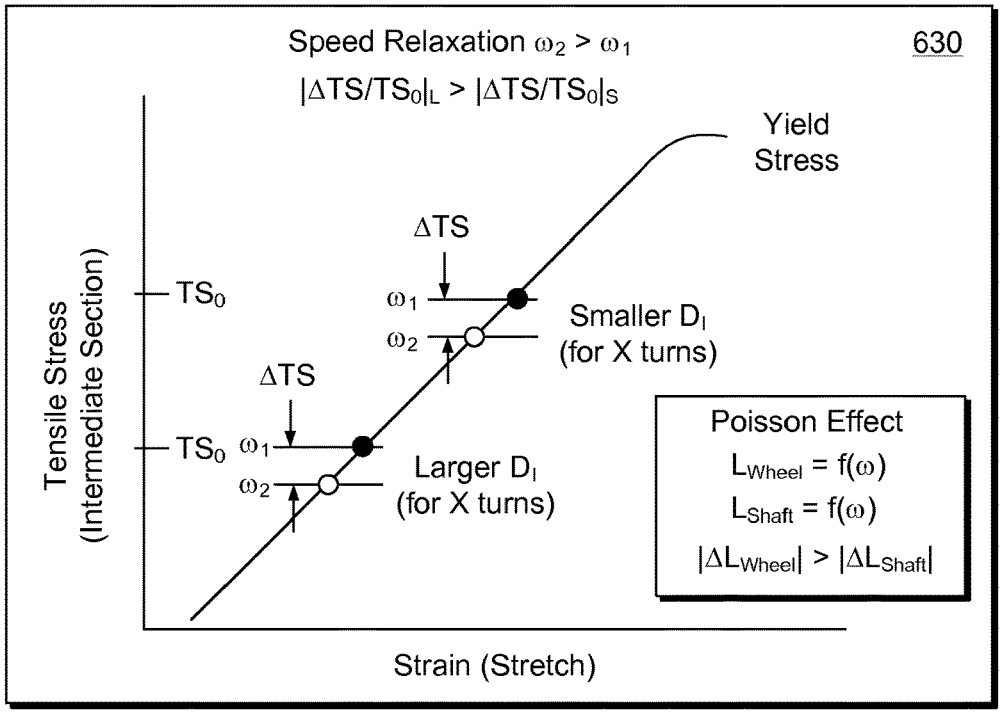

FIG. 6 shows two example plots 610 and 630. The plot 610 shows tensile stress versus strain for a change in temperature (e.g., $T_2>T_1$). For a case where the coefficient of expansion ($\alpha$) is greater for a compressor wheel compared to a shaft (e.g., consider aluminum and steel, respectively), the increase in temperature will cause the compressor wheel to expand axially more than the shaft. In turn, the compressive load will increase on the compressor wheel (e.g., nut fixed to shaft) and the tensile load will increase on the shaft. As tensile load increases, the tensile stress will increase. As indicated, the change in tensile stress is, percentagewise, less for a higher initial tensile stress. In particular, a smaller diameter portion of a shaft will experience, percentagewise, a lesser increase than a larger diameter portion of a shaft given an increase in temperature. Such a percentagewise change also holds for the case where the coefficient of expansion is greater for a shaft than for a compressor wheel because the initial tensile stress is higher for a smaller diameter portion of a shaft compared to a larger diameter portion of a shaft for a given initial load. Accordingly, a higher initial tensile stress achieved by a reduction in diameter of a portion of a shaft can act to reduce the percentagewise effect of temperature, which may be referred to as a temperature relaxation effect.

The plot 630 shows tensile stress versus strain for a change in rotational speed (e.g., $\omega_2>\omega_1$) to illustrate the Poisson effect, which causes a compressor wheel to contract with respect to increasing rotational speed (e.g., angular velocity). In general, a compressor wheel will contract more than a shaft for a given rotational speed. Thus, the compressive load applied to the compressor wheel and the tensile load applied to the shaft will decrease. For example, the nut 270 may become "looser" for excessive speed, especially at low temperatures (e.g., where thermal expansion does not counter or otherwise impact effect of speed). In such cases where a shaft may have a higher coefficient of expansion than a wheel, high speed and high temperature may be problematic as both can act to diminish load.

As shown in the plot 630, for a given increase in speed, a smaller diameter portion of a shaft experiences, percentagewise, a smaller change in tensile stress than a larger diameter portion of a shaft (e.g., for a given initial load, which may be represented by a number of turns). Accordingly, a higher initial tensile stress achieved by a reduction in diameter of a portion of a shaft can act to reduce the percentagewise effect of rotational speed, which may be referred to as a speed relaxation effect.

As mentioned, various phenomena can depend on the nature of components, including materials of construction. As described herein, a compressor wheel may be constructed of aluminum, titanium or other material and a shaft may be constructed of steel or other material. Where an assembly includes an aluminum (e.g., aluminum or aluminum alloy) compressor wheel and a steel (e.g., stainless or other steel) shaft, as temperature increases, load is likely to increase and as rotation speed increases, load is likely to decrease.

Figure 7A:
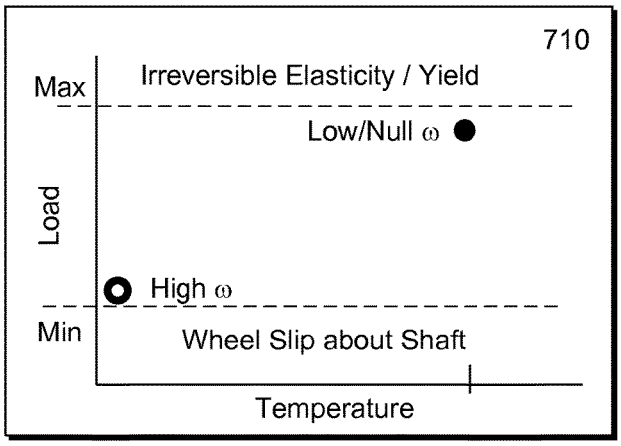
FIGS. 7A, 7B and 7C are a series of plots for examples of operational conditions.
Figure 7B:
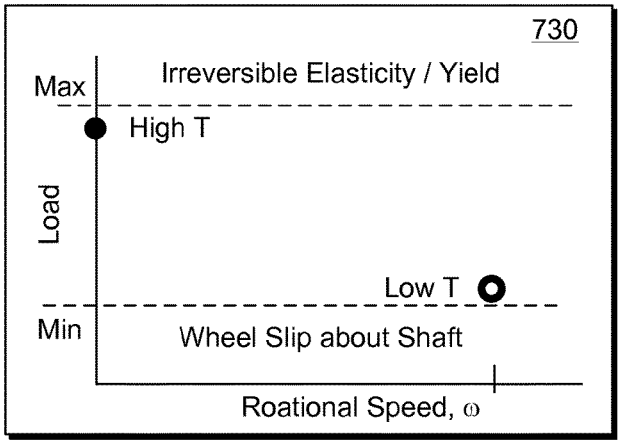
Figure 7C:
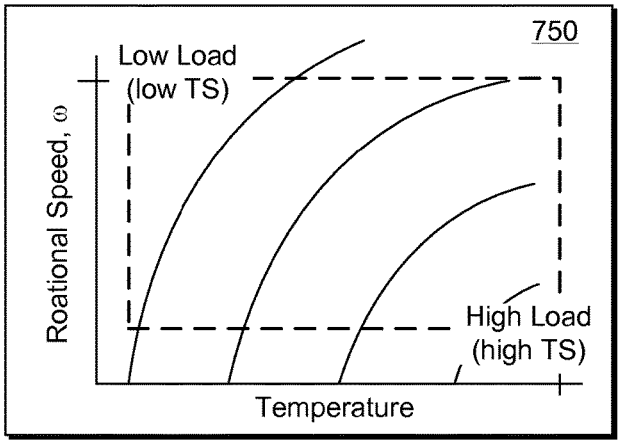

FIG. 7 shows a series of plots 710, 730 and 750 that illustrate some examples of load with respect to temperature, rotational speed and temperature and rotational speed. The plot 710 shows load versus temperature along with a maximum load and a minimum load. The maximum load may correspond to irreversible elasticity or yield while the minimum load may correspond to a load that ensures a compressor wheel does not slip about a shaft (e.g., below this load, slippage may be expected).

The plot 730 shows load versus rotational speed along with a maximum load and a minimum load. The maximum load may correspond to irreversible elasticity or yield while the minimum load may correspond to a load that ensures a compressor wheel does not slip about a shaft (e.g., below this load, slippage may be expected).

The plot 750 shows rotational speed versus temperature with contours that represent levels of load and where a dashed box represents a load/stretch window for rotational speed and temperature. At an upper left corner, a low load condition may exist while at the lower right corner, a high load condition may exist.

Where an assembly is constructed to provide a high initial tensile stress, for example, upon manufacture, the assembly may, percentagewise, be less impacted by changes in temperature, rotational speed or temperature and rotational speed. As described herein, a high initial tensile stress may be achieved by providing a shaft that includes a recessed or undercut portion that spans two pilots where the pilots seat a compressor wheel. Further, a distance between two pilots may be selected to reduce risk of tilt. For example, a distance may be selected with respect to a length of a compressor wheel to position one pilot proximate to a nose end of the compressor wheel and another pilot proximate to a base end of the compressor wheel. In such a manner, the distance between the two pilots is at or near a maximum.

Figure 8:
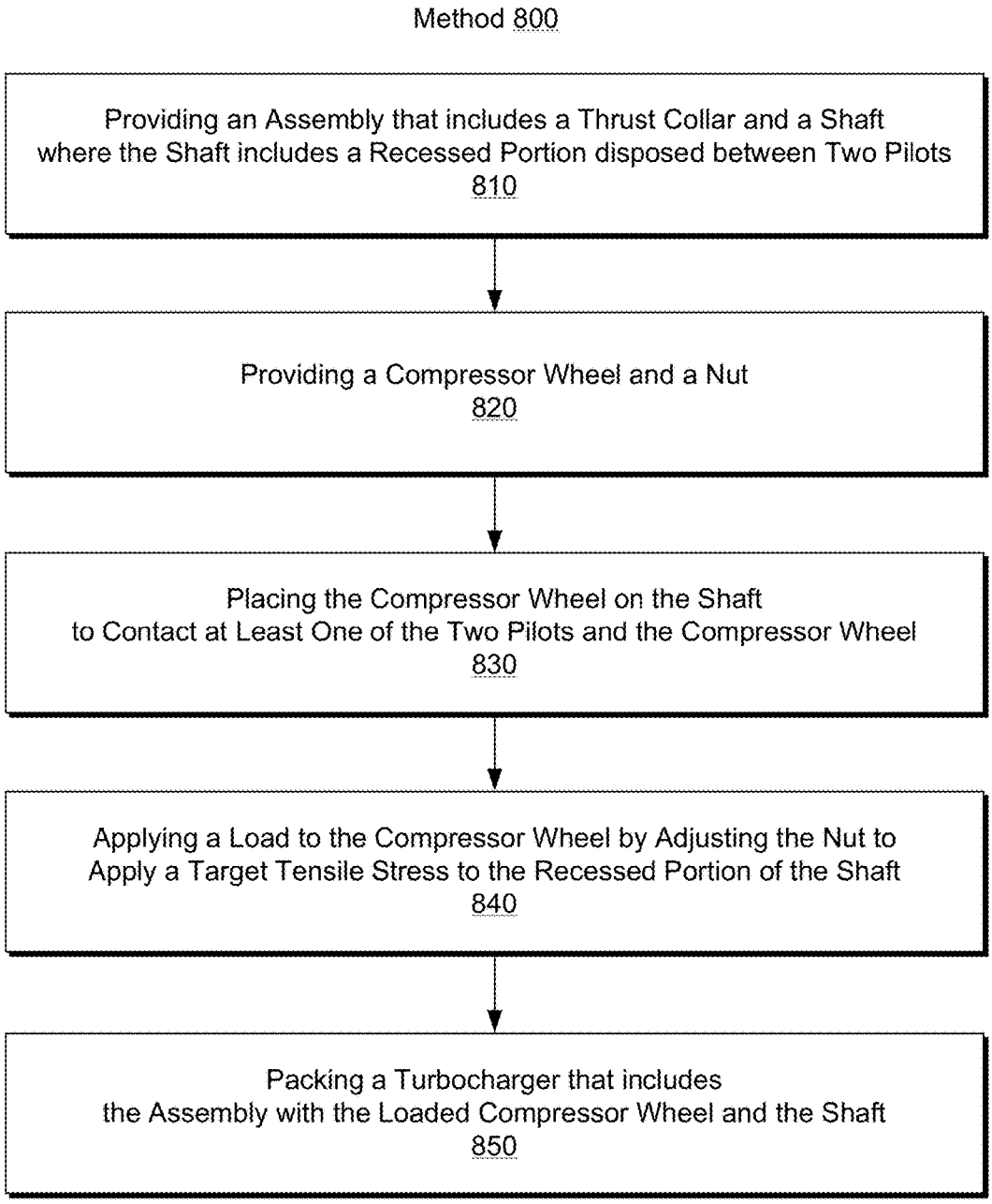
FIG. 8 is a block diagram of an example of a method.

FIG. 8 shows an example of a method 800. The method 800 include a provision block 810 for providing an assembly that includes a thrust collar and a shaft where the shaft includes a recessed portion disposed between two pilots, a provision block 820 for providing a compressor wheel and a nut, a placement block 830 for placing the compressor wheel on the shaft to contact at least one of the two pilots and the compressor wheel (e.g., to contact at least one of the two pilots via a press-fit into a bore of the compressor wheel), an application block 840 for applying a load to the compressor wheel by adjusting the nut to apply a target tensile stress to the recessed portion of the shaft, and a package block 850 for packaging a turbocharger that includes the assembly with the loaded compressor wheel and the shaft. As mentioned, one pilot may be configured to allow for some play with respect to a bore of a compressor wheel while another pilot may be configured for an interference fit (e.g., a press-fit) with respect to a bore of a compressor wheel. In such an example, placing may place two pilots into a bore of a compressor wheel, one without interference and the other with interference (e.g., where some force is applied to overcome interference force between the bore of the compressor wheel and the interference fit pilot).

As described herein a method can include providing an assembly that includes a thrust collar and a shaft rotatably supported in a housing where the shaft includes a recessed portion disposed between two pilots; providing a compressor wheel and a nut; placing the compressor wheel on the shaft to contact at least one of the two pilots and the compressor wheel in a bore of the compressor wheel (e.g., optionally contact achieved via press-fitting); applying a load to the compressor wheel by adjusting the nut to apply a target tensile stress to the recessed portion of the shaft; and packaging a turbocharger that includes the assembly with the loaded compressor wheel and the shaft (e.g., assembling a turbocharger with the assembly as a sub-assembly thereof).

As described herein, a method can include operating a turbocharger within a load/stretch window defined by a recessed portion of the shaft. As an example, packaging can include operating instructions based at least in part on a load/stretch window defined by the recessed portion of the shaft. Such instructions may optionally be in the form of one or more computer-readable storage media. For example, where a controller (e.g., ECU or other) includes memory that stores instructions, such instructions may be loaded into the memory to control operation of an engine, a turbocharger, EGR, etc., to conform to a load/stretch window (e.g., defined at least in part by a recessed portion of a turbocharger shaft).

As described herein, various acts may be performed by a controller (see, e.g., the controller 190 of FIG. 1), which may be a programmable control configured to operate according to instructions. As described herein, one or more computer-readable media may include processor-executable instructions to instruct a computer (e.g., controller or other computing device) to perform one or more acts described herein. A computer-readable medium may be a storage medium (e.g., a device such as a memory chip, memory card, storage disk, etc.). A controller may be able to access such a storage medium (e.g., via a wired or wireless interface) and load information (e.g., instructions and/or other information) into memory (see, e.g., the memory 194 of FIG. 1). As described herein, a controller may be an engine control unit (ECU) or other control unit. Such a controller may optionally be programmed to control lubricant flow to a turbocharger, lubricant temperature, lubricant pressure, lubricant filtering, exhaust gas recirculation, etc. Such a controller may optionally be programmed to perform, monitor, etc., a loading process. For example, such a controller may be programmed to monitor force, control a force application tool, etc., to apply a target tensile stress to a portion of a turbocharger shaft. Such a controller may optionally be programmed to perform one or more actions described with respect to example methods described herein or other methods.

Although some examples of methods, devices, systems, arrangements, etc., have been illustrated in the accompanying Drawings and described in the foregoing Detailed Description, it will be understood that the example embodiments disclosed are not limiting, but are capable of numerous rearrangements, modifications and substitutions without departing from the spirit set forth and defined by the following claims.

What is claimed is:

1. A turbocharger assembly comprising:

a housing that comprises a turbine side, a compressor side and a bore that extends from the compressor side to the turbine side;

a bearing disposed in the bore of the housing;

a compressor wheel that comprises a base surface, a nose surface, a z-plane disposed between the base surface and the nose surface and a bore extending from the base surface to the nose surface;

a shaft rotatably supported by the bearing in the bore of the housing wherein the shaft comprises a free end, an opposing turbine wheel end, a shoulder disposed between the free end and the turbine wheel end, wherein the shoulder and the free end define a compressor wheel portion of the shaft that comprises a first pilot surface disposed in the bore of the compressor wheel at a position between the z-plane and the nose surface and having a first pilot diameter, a second pilot surface disposed in the bore of the compressor wheel, in part between the z-plane and the base surface and in part between the z-plane and the nose surface of the compressor wheel, and having a second pilot diameter that exceeds the first pilot diameter, a first recessed surface disposed between the first pilot surface and the second pilot surface, and a second recessed surface disposed between the second pilot surface and the shoulder and at least in part between the z-plane and the base surface of the compressor wheel;

a back plate disposed between the compressor wheel and the housing, wherein the back plate comprises a back plate bore;

a thrust collar disposed at least in part in the back plate bore and about the shaft between the bearing and the base surface of the compressor wheel, wherein the thrust collar comprises an interior surface that seats the shoulder of the shaft;

a locating pin that locates the bearing in the bore of the housing between the thrust collar and the turbine wheel; and a nut adjustably disposed on the shaft adjacent to the nose surface of the compressor wheel wherein adjustment of the nut tensions the compressor wheel portion of the shaft to apply a compressive load between the base surface and the nose surface of the compressor wheel.

2. The turbocharger assembly of claim 1 wherein the first pilot comprises an axial length that is less than an axial length of the second pilot.

3. The turbocharger assembly of claim 1 comprising a third recessed surface disposed between the first pilot and the free end of the turbocharger shaft.

4. The turbocharger assembly of claim 3 comprising threads disposed between the third recessed surface and the free end of the turbocharger shaft.

5. The turbocharger assembly of claim 1 wherein the thrust collar and the nut apply the compressive load to the base surface and the nose surface of the compressor wheel.

6. The turbocharger assembly of claim 1 wherein the compressive load applies a tensile load to the shaft.

7. The turbocharger assembly of claim 1 wherein the compressive load applies a tensile load to the shaft between the shoulder of the shaft and a portion of the shaft contacted by the nut.

8. The turbocharger assembly of claim 1 wherein the nut comprises threads and wherein the shaft comprises threads for adjustment of the nut on the shaft.

9. The turbocharger assembly of claim 1 wherein a relationship exists between the applied compressive load and number of turns of the nut.

10. The turbocharger assembly of claim 1 wherein the compressor wheel comprises a linear thermal coefficient of expansion that exceeds a linear thermal coefficient of expansion of the shaft.

11. The turbocharger assembly of claim 1 wherein the compressor wheel comprises aluminum and wherein the shaft comprises steel.

12. The turbocharger assembly of claim 1 wherein the recessed surface disposed between the first pilot surface and the second pilot surface comprises a length to minimize axial tilt of the compressor wheel with respect to the shaft.

13. The turbocharger assembly of claim 12 wherein the length defines a distance between the first pilot surface and the second pilot surface.

14. The turbocharger assembly of claim 1 wherein the second pilot surface comprises a press-fit surface press-fit into the bore of the compressor wheel.

15. The turbocharger assembly of claim 14 wherein the first pilot surface comprises a play surface having a diameter less than a diameter of the bore of the compressor wheel.

* * * * *